US005226270A

United States Patent [19]

Stahlecker

[11] Patent Number: 5,226,270

[45] Date of Patent: Jul. 13, 1993

[54] SLIVER FEEDING MECHANISM FOR A SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany; part interest to each

[21] Appl. No.: 846,890

[22] Filed: Mar. 6, 1992

[30] Foreign Application Priority Data

Mar. 20, 1991 [DE] Fed. Rep. of Germany ..... 4109099

[51] Int. Cl.[5] ..... D01H 13/04

[52] U.S. Cl. ..... 57/90; 57/315

[58] Field of Search ..... 57/90, 315, 75

[56] References Cited

U.S. PATENT DOCUMENTS

| | | | |
|---|---|---|---|
| 2,896,269 | 7/1959 | Gardella et al. | 57/315 X |
| 3,191,375 | 6/1965 | Naegeli | 57/315 X |
| 3,312,050 | 4/1967 | Noguera | 57/90 |
| 3,469,385 | 9/1969 | Tsuzuki | 57/90 X |
| 3,564,829 | 2/1971 | Tsuzuki | 57/90 X |
| 3,816,991 | 6/1974 | Takeuchi et al. | 57/90 |

FOREIGN PATENT DOCUMENTS

| | | |
|---|---|---|
| 817572 | 8/1951 | Fed. Rep. of Germany . |
| 2335740 | 11/1974 | Fed. Rep. of Germany . |

*Primary Examiner*—Joseph J. Hail, III

*Attorney, Agent, or Firm*—Evenson, McKeown, Edwards & Lenahan

[57] ABSTRACT

In the case of a spinning machine having spinning stations arranged on both sides of the machine for the spinning of yarns from slivers which are fed to the spinning stations in cans deposited above the spinning machine, the slivers are guided from the cans to the spinning stations by guiding devices. In the area of the center plane of the spinning machine, the guiding devices comprise two skids which extend vertically at a distance from one another, are each assigned to one side of the machine and are pressed apart in the manner of a fishbelly bulge by spreader devices. A transport belt which is placed against the skid is assigned to each skid and transports one sliver or several slivers.

17 Claims, 3 Drawing Sheets 17
16
16'
10
10'
13
13'
E
E'
14
14'
15
15'
12
12'
A
A
4
4'
7
7'
B
B
5
5'
19
19'
20
20'
8
8'
a
18
18'
6
9
9'
D
D'
3
3'
2
2'
1
C
C
11

Fig.6
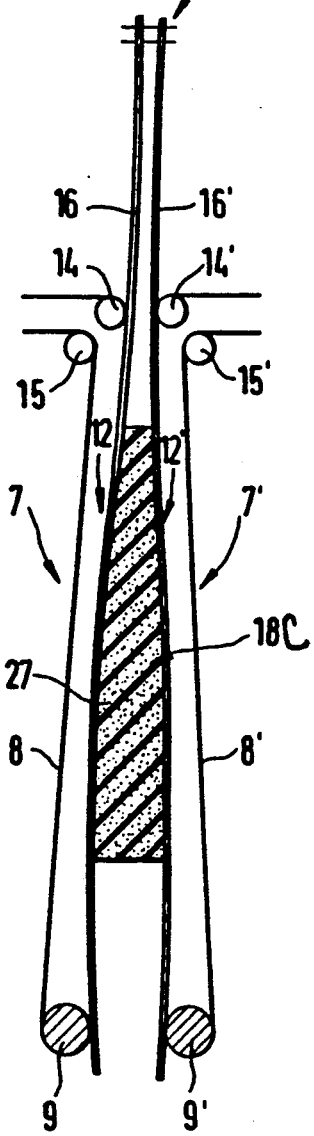
Fig.7
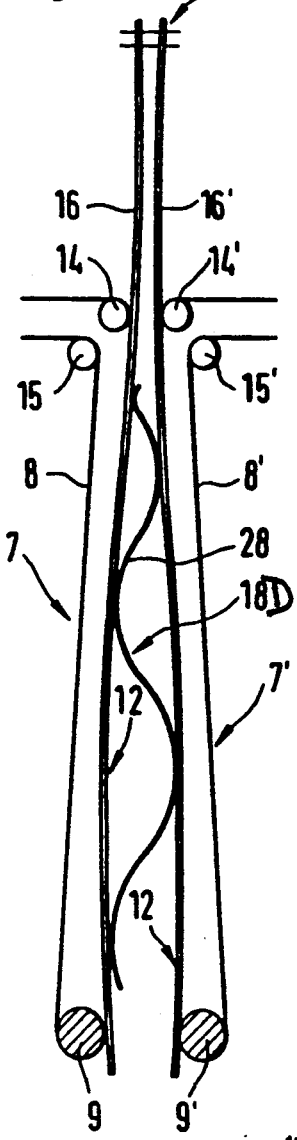
Fig.8
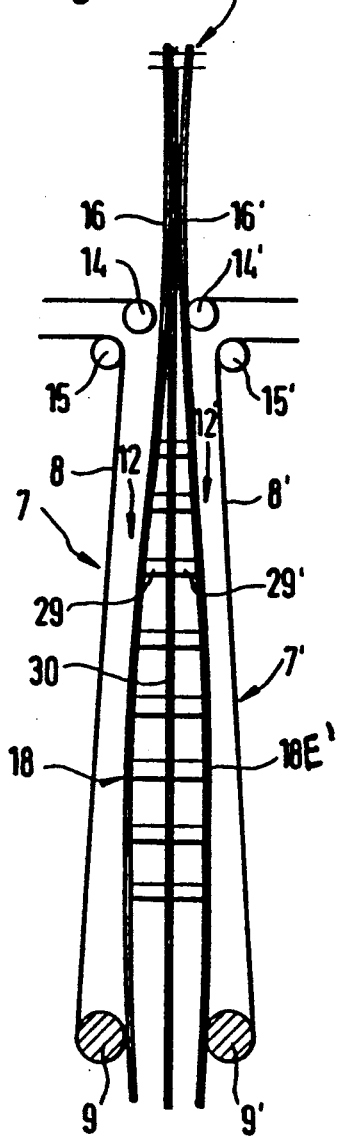
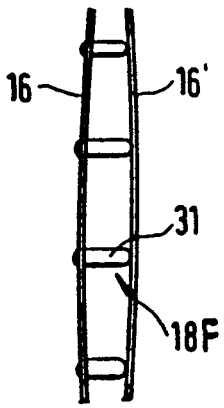
Fig.9
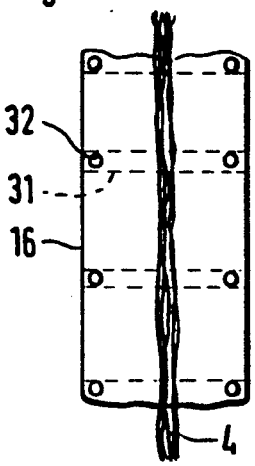
Fig.10

SLIVER FEEDING MECHANISM FOR A SPINNING MACHINE

BACKGROUND AND SUMMARY OF THE INVENTION

This invention relates to a spinning machine having spinning stations arranged on both sides of the machine for the spinning of yarns from slivers which are fed to the spinning stations in cans deposited above the spinning machine, guiding devices for the slivers being arranged between the cans and the spinning stations.

The feeding of the fiber material to be spun in the form of slivers disposed in cans is known, for example, in the case of open-end spinning machines. In the case of the commercially available machines, the slivers are withdrawn directly by the sliver feeding device of the individual spinning stations from the cans standing in front of and partially below the spinning arrangement.

It is also known (German Patent Document DE-C 23 35 740), in the case of open-end spinning machines, to arrange the cans on a platform above the spinning machine and to feed the slivers through guiding tubes to the spinning stations. These guiding tubes, which are equipped with baffles, are to be used as an intermediate storage device which, because of a special construction, is fed by a continuously running feeding device nevertheless intermittently. The sliver should then be guided through the respective guiding tube essentially free of tensile stress.

The feeding of fiber material in the form of slivers made available in cans is also known in the case of other fast running spinning machines, for example, in the case of wind-around spinning machines or air spinning machines. As a rule, these are one-sided machines, in which the slivers, which were withdrawn from the cans deposited on the rear of the spinning machine, are fed from above to the spinning stations. In this case, guiding devices are provided in the form of rollers and guide rods for the slivers.

It is also known (German Patent Document DE-PS 817 572), in the case of ring spinning machines, to feed slivers in cans which are deposited on platforms or in a space above the spinning machine. In this case, relatively long paths with one or several vertical runs are obtained which lead to the risk that the slivers may hang out; that is, are drafted uncontrollably because of their own weight. Such an arrangement is therefore possible only for slivers which have a relatively coarse size and thus a relatively high stability.

However, the spinning of slivers of relatively coarse sizes is very difficult on ring spinning machines. Since the ring spinning machines have only a relatively low delivery speed at the outlet of the drafting units,—taking into account the required draft—the feeding rollers of the drafting units must run very slowly; that is, at rotational speeds of one revolution per minute and less. It is technically very difficult to let long shafts, like the feeding rollers of drafting units, run at such low rotational speeds with sufficient precision. There is the risk that these shafts will rotate only jerkily so that no controlled draft is obtained. The feeding of the fiber material to be spun in cans has therefore not been carried out successfully in practice in the case of ring spinning machines.

In related U.S. copending applications Ser. No. 809,141, filed Dec. 18, 1991 and Ser. No. 948,638, filed Sep. 23, 1992 it is suggested to provide transport belts as guiding devices which interact with one skid respectively. The skids extend in the area of the center plane of the spinning machine in the vertical direction and each have a curvature in the direction to the downward travelling runs of the transport belts. The skids abut at their respective ends and are mutually supported there.

It is an object of the invention to develop a spinning machine of the initially mentioned type in such a manner that also fine slivers may be fed in cans without the risk of faulty drafts, particularly in vertical runs of the transport path.

This object is achieved in that the guiding devices, in the area of the center plane of the spinning machine, comprise skids which are arranged vertically and spaced from one another, are assigned to one side of the machine respectively and are pressed apart in the manner of a fishbelly or convex curved shaped by means of spreader devices, and in that a transport belt is assigned to each skid which is in close contact with the respective associated skid and transports one or several slivers.

In the case of the development according to the invention, it is achieved that the slivers are supported and are nevertheless moved in the transport direction. As a result, it is possible to feed also relatively thin slivers in cans; that is, slivers of sizes of approximately Nm 0.4 to 0.8. In this case, these fine slivers may also be transported in the vertical direction along larger runs. It is therefore possible to carry out a can feeding also in the case of ring spinning machines because, on the basis of the slivers with the fine sizes, while taking into account the draft, the feeding roller pairs of the drafting units still run at a sufficiently high speed so that a uniform round rotating is ensured. By means of this can feeding, it will then be possible, in the case of ring spinning machines, to do without a premounted machine, specifically the flyer. In the case of other spinning machines, which are equipped with drafting units into which the slivers travel, it is possible to feed finer slivers so that then the drafting units may be simplified. For example, in the case of machines of this type, there is the possibility to use, instead of five-cylinder drafting units, the three-cylinder drafting units which are customary today in the case of ring spinning machines.

Also in the case of open-end machines, the feeding of finer slivers results in advantages because then the opening-up work for the separating of the fibers is reduced so that, during the opening-up, the fibers are processed more carefully. It is therefore possible to spin finer yarns with less damaged fibers so that the yarns have a higher quality.

The pressing-apart of the skids in the manner of a fishbelly caused by the spreader devices has the result that the transport belts establish a soft contact. In this case, the spreader devices are arranged approximately in the center in the case of skids of a length of approximately two meters. In the center of the skids, the bulging-out is the most pronounced; it is the least pronounced on the very top and on the very bottom. The "fishbelly" is only very slight. In the area of the deflection rollers of the transport belts, the skids must not be supported by spreader devices so that they can spring there freely and are sufficiently soft.

Other objects, advantages and novel features of the present invention will become apparent from the following detailed description of the invention when considered in conjunction with the accompanying drawings.

BRIEF DESCRIPTION OF THE DRAWINGS

FIGS. 6 to 8 respectively are partial cross-sectional views similar to FIG. 1 with alternative constructions for the spreader devices of the skids;

FIG. 9 is a cutout of FIG. 8 with spreader devices riveted to a skid; and

FIG. 10 is the lateral view according to FIG. 9.

DETAILED DESCRIPTION OF THE DRAWINGS

Figure 1:
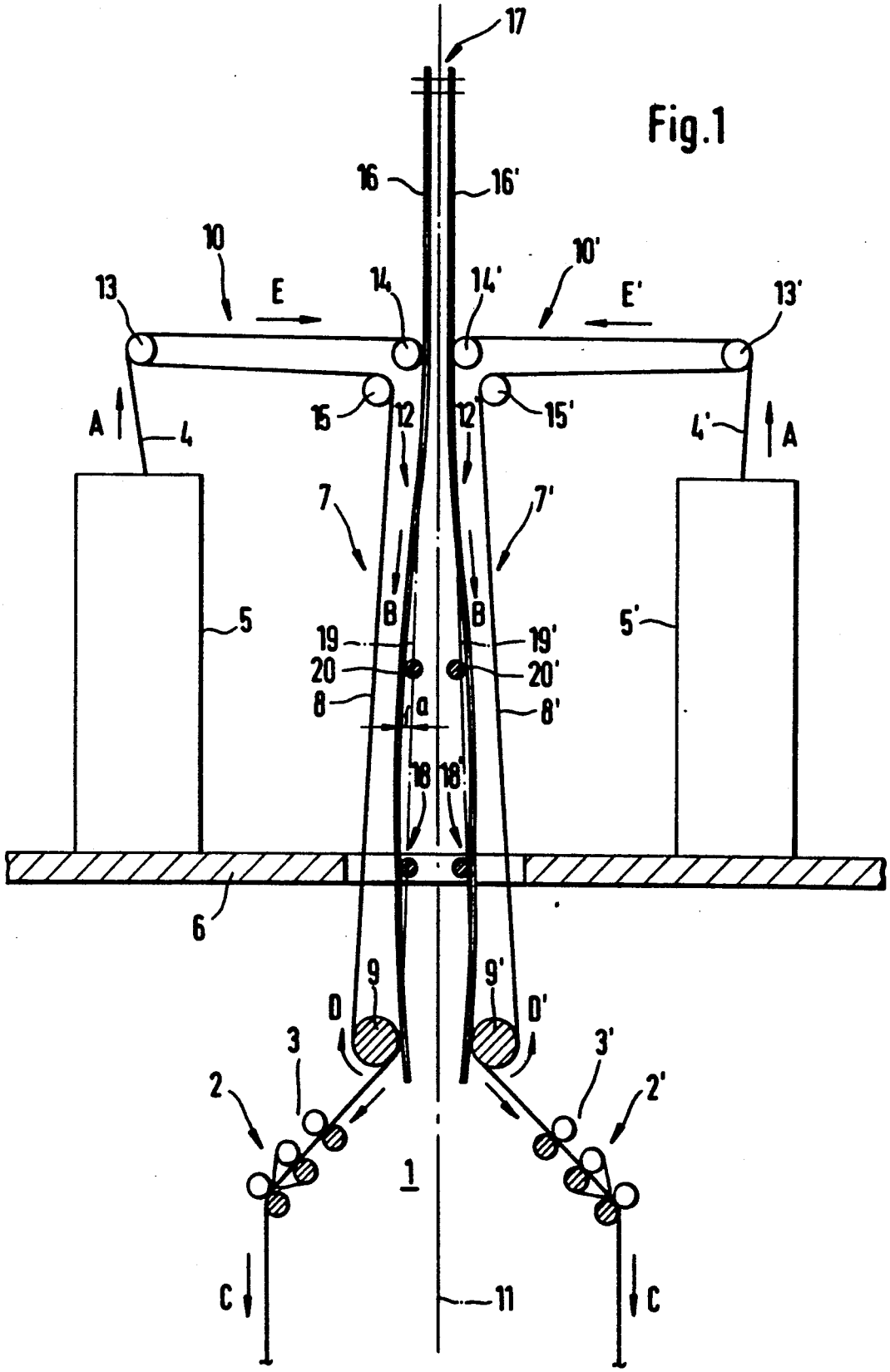
FIG. 1 is a partial cross-sectional view of a spinning machine, in which case only one drafting unit of a spinning station of each side of the machine is shown to which a sliver is fed from a can deposited on a platform, in which case the sliver is transported by a transport belt against which a skid is pressed, constructed according to a preferred embodiment of the invention.

In FIG. 1, only two spinning stations 2 and 2' are shown of a spinning machine 1 which each pertain to a side of the machine and of which only one drafting unit 3 or 3' is shown. However, such a spinning machine 1 comprises a plurality of such spinning stations 2 and 2' which are arranged in a row next to one another on one side of the machine or on both sides of the machine. A twist-providing machine, such as a ring spindle or a wind-around spindle or an air nozzle, which is not shown connects to each drafting unit 3, 3'. Likewise, a sliver feeding device of an open-end spinning machine may be arranged instead of the drafting unit 3, 3'. At each of these spinning stations 2, 2', a sliver 4 is withdrawn from a can 5 or 5' and spun into a yarn.

The cans 5, 5' of the individual spinning stations 2, 2' are disposed above the spinning machine 1 on a platform 6. The cans 5, 5' which normally have an outside diameter which is larger than the spacing of the spinning stations 2, 2' (spacing of the spinning stations 2, 2' in the longitudinal direction of the machine) are deposited in several rows extending in the longitudinal direction of the spinning machine 1.

The slivers 4, 4' are withdrawn in the direction of the arrow A upward from the cans 5, 5' which are open on top and are then transported downward to the drafting units 3, 3' in the direction of the arrow B. In order to securely bridge this path also in the case of fine sizes of the slivers 4, 4' without the occurrence of faulty drafts in the fine slivers 4, 4', special guiding devices 7, 7' are provided. The slivers 4, 4' drafted in the drafting units 3, 3' are fed in the direction of the arrow C to a twist providing device which is not shown.

For each spinning station, the guiding devices 7, 7' comprise an endless transport belt 8 or 8' which is driven by a driving pulley 9 or 9' in the direction of the arrow D or D'. The driving pulleys 9, 9' are at the same time used as deflection pulleys and are situated directly in front of the pair of feeding rollers of the pertaining drafting unit 3, 3'.

In the area of the cans 5, 5', the respective driving belt 8, 8' has a horizontally extending run 10 or 10' in which the sliver 4, 4' is transported in the direction of the arrow E or E' toward the center plane 11 of the spinning machine 1. The horizontal run 10, 10' then changes into a vertical run 12, 12'. In this vertical run 12, 12', the transport belts 8, 8' have a narrow distance from one another.

The horizontal run 10, 10' of the transport belts 8, 8' is defined by deflection pulleys 13 or 13', 14 or 14' as well as 15 or 15'. In this case, the deflection pulleys 13, 13' are disposed approximately centrically above the pertaining can 5, 5'. The other deflection rollers 14, 14' as well as 15, 15' define the transition from the respective horizontal run 10, 10' to the vertical run 12, 12'.

In the area of the center plane 11 of the spinning machine 1, the guiding devices 7, 7' comprise two skids 16 and 16' which extend substantially vertically and are arranged at a spacing with respect to one another and are in each case assigned to one side of the machine. These skids 16, 16' are suspended above the spinning machine 1 in a manner that is to be described in detail by means of a hang-in device 17, specifically so that the skids 16, 16' can swivel out away from the center plane 11 of the spinning machine 1.

The skids 16, 16' have approximately the same width as the transport belts 8, 8'. They extend only along the vertical run 12, 12' and start at a larger distance above the upper deflection rollers 14, 14'. In the downward direction, they reach beyond the driving pulleys 9, 9'. The driving pulleys 9, 9', in this case, are continuous cylinder trains which, because of their drive on the machine start and also because of their bearing on the machine sections, have a slightly larger distance from one another than the upper deflection pulleys 14, 14'.

The skids 16, 16' are spread apart in the manner of a fishbelly by means of spreader devices 18, 18'. This fishbelly-type spreading-apart of the skids 16, 16', which are approximately two meters long, is relatively slight. The spreading-apart should be just far enough for the transport belts 8, 8' in the vertical run 12, 12' to be placed very softly against the skids 16, 16'. This becomes clear when an imaginary straight line 19 or 19', which is shown by a dash-dotted line, is compared with the contour of the skids 16, 16'. The maximal deflection of the skids 16, 16' from this straight line 19, 19' should not exceed a measurement a of approximately 20 mm. The resulting "fishbelly" is therefore very slender.

The spreader devices 18, 18' may be formed as round rails 20, 20' which extend, for example, along a machine section. In the present case of FIG. 1, two of such round rails 20, 20' are assigned to each skid 16, 16' at a certain distance above one another.

It is important that the spreader devices 18, 18' have a fairly large distance from the driving pulleys 9, 9' and the deflection pulleys 14, 14'. This ensures that the skids 16, 16', in the area of the driving pulleys 9, 9' and the deflection pulleys 14, 14' are placed very softly against the transport belts 8, 8'. The contact pressure force should be between 0.5 and 0.8N.

As illustrated in FIG. 1, the distance of the skids 16, 16' is smaller in the area of the suspension 17 than in the area of the driving pulleys 9, 9'. Approximately in the center of the vertical run 12, 12', the fishbelly-type bulging of the skids 16, 16' is the most pronounced. In the area of the driving pulleys 9, 9' and of the deflection pulleys 14, 14', the skids 16, 16' must be free and must be able to be resilient; that is, in this area, the skids 16, 16' must not be hard and must not be prevented from escaping. The contact pressure of the skids 16, 16' should be the same for both sides of the machine.

Figure 2:
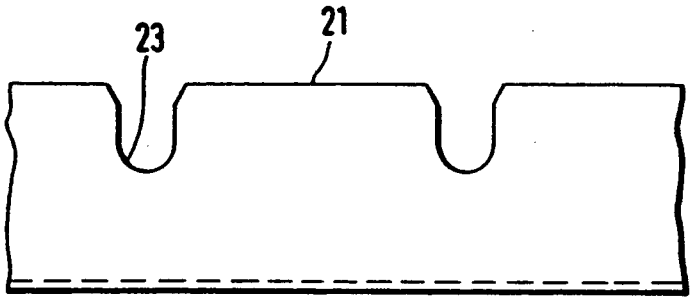
FIG. 2 is a view of a part of a rail extending in the longitudinal direction of the machine for the suspending of the skids of the FIG. 1 arrangement.
Figure 3:
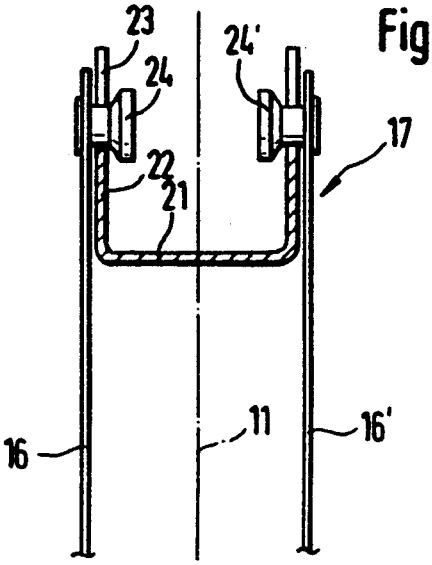
FIG. 3 is a cross-sectional view of the rail of FIG. 2 with a swivelling suspension of two skids.

In FIGS. 2 and 3, the suspension 17 for the skids 16, 16' is shown in an enlarged scale. A U-shaped rail 21, which extends through in the longitudinal direction of the machine, is provided precisely in the center plane 11 of the spinning machine 1 above the platform 6. According to the spacing of the spinning stations 2, 2', the rail 21 has recesses 23 in its flanges 22. The skids 16, 16' are hung into these recesses 23 by means of plastic buttons 24, 24' which are mounted on the skids 16, 16'. The skids 16, 16' can therefore be easily demounted.

Figure 4:
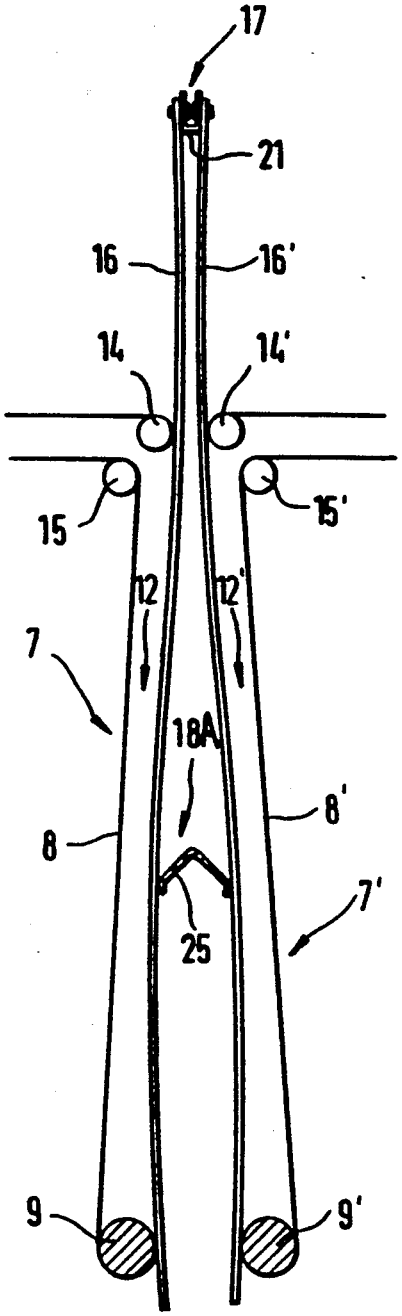
FIG. 4 is a partial cross-sectional view similar to FIG. 1 with differently constructed spreader devices for the skids.

Different spreader devices 18, 18' will be described with respect to the following figures:

A transport belt 8, 8' with the driving pulleys 9, 9' as well as the deflection pulleys 14 and 15 or 14', 15' is illustrated in FIG. 4 for each side of the machine. The transport belts 8, 8' are placed very softly against the skids 16, 16' which are spread apart in the manner of a fishbelly. On the top, the skids 16, 16' are again hung in a suspension 17 in the above-described manner. As the spreader device 18, an angle rail 25 is provided which extends in the longitudinal direction of the machine along approximately one machine section and which is mounted approximately in the center in the vertical run 12, 12'. Expediently, as an alternative, two of such spreader rails 25 respectively may be assigned to the guiding devices 7, 7'.

Figure 5:
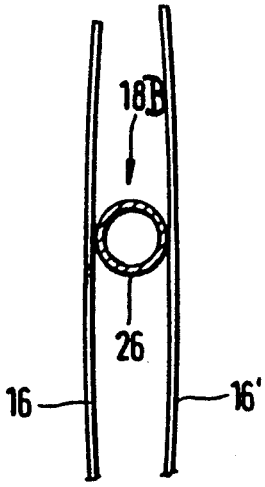
FIG. 5 is a cutout similar to FIG. 4 with a differently constructed spreader device for the skids.

In the variant according to FIG. 5, the spreader device 18B comprises a tube 26 which extends in the longitudinal direction of the machine and the diameter of which is selected such that the desired fishbelly-type bulging of the skids 16, 16' is achieved.

In the embodiment according to FIG. 6, a foam 27 is sprayed as the spreader medium 18C in the vertical runs 12, 12' between the skids 16, 16'. This foam 27 is firmly bonded in this case with the skids 16, 16'. This also leads to the slight fishbelly-type bulging.

In the embodiment according to FIG. 7, the skids 16, 16' are spread apart in the manner of a fishbelly by means of a corrugated spring 28. This spreader device 18D, which is designed as a corrugated spring 28, may consist of a sheet metal strip extending in a serpentine manner as illustrated. In the center, the serpentine of the corrugated spring 28 is the most pronounced; it is the least pronounced on the very top and the very bottom. However, as an alternative, hump-type elevations 29, 29' may also be provided as the spreader device 18E, 18E', as illustrated in FIG. 8. These hump-type elevations 29, 29' are provided at certain distances on a sheet metal strip 30 extending in the center between the skids 16, 16'. The height of the hump-type elevations 29, 29' is selected such that the desired fishbelly-type bulging of the skids 16, 16' is obtained.

According to FIG. 9, hump-type elevations 31 of the spreader device 18F may also be achieved by the fact that the hump-type elevations 31 are riveted to one of the two skids 16, 16'. In this case, the rivets 32 are situated on the edges of the transport belts 16, 16' so that the slivers 4, 4' can extend between the rivets 32 (see FIG. 10).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A sliver guiding arrangement for guiding sliver from sliver cans deposited above a pair of spinning stations disposed at opposite sides of a spinning machine, said sliver guiding arrangement including:

a pair of vertically extending sliver guide skids disposed in a central plane of the spinning machine between a pair of spinning stations, a pair of sliver transport belts which have respective vertically extending runs facing respective ones of the pair of sliver guide skids to thereby transport the slivers downwardly with guided support of the slivers by the respective transport belt and guide skid, and spreader devices disposed between the pair of guide skids toward the respective sliver transport belts with a bulging of the guide skids away from one another along their central sections.

2. An arrangement according to claim 1, wherein the guide skids are spring bands.

3. An arrangement according to claim 2, wherein the guide skids are hung onto a suspension member in the center plane of the spinning machine so that they can be swivelled out on their upper ends.

4. An arrangement according to claim 1, wherein the guide skids are hung onto a suspension member in the center plane of the spinning machine so that they can be swivelled out on their upper ends.

5. An arrangement according to claim 4, wherein upper deflection rollers are assigned to the transport belts and are arranged at a clear distance below the suspension member of the skids.

6. An arrangement according to claim 5, wherein upper and lower deflection rollers are assigned to the transport belts and are arranged at a clear distance from the spreader devices.

7. An arrangement according to claim 6, wherein the spreader devices are constructed as spring elements.

8. An arrangement according to claim 6, wherein the spreader devices are constructed as a filler disposed between the skids.

9. An arrangement according to claim 6, wherein the spreader devices are constructed as rails which extend along several pairs of spinning stations and are arranged above one another at a distance from one another.

10. An arrangement according to claim 6, wherein the bulging of the skids is larger in a lower area than in an upper area thereof.

11. An arrangement according to claim 6, wherein the bulging of the skids amounts to maximally approximately 20 mm from a straight line.

12. An arrangement according to claim 4, wherein upper and lower deflection rollers are assigned to the transport belts and are arranged at a clear distance from the spreader devices.

13. An arrangement according to claim 12, wherein the spreader devices are constructed as spring elements.

14. An arrangement according to claim 12, wherein the spreader devices are constructed as a filler disposed between the skids.

15. An arrangement according to claim 12, wherein the spreader devices are constructed as rails which extend along several pairs of spinning stations and are arranged above one another at a distance from one another.

16. An arrangement according to claim 1, wherein the bulging of the skids is larger in a lower area than in an upper area thereof.

17. An arrangement according to claim 1, wherein the bulging of the skids amounts to maximally approximately 20 mm from a straight line.

* * * * *